US005095625A

United States Patent [19]

Zimmerman

[11] Patent Number: 5,095,625

[45] Date of Patent: Mar. 17, 1992

[54] ADHESIVE APPLICATOR FOR CONTOURED SURFACES

[76] Inventor: Arthur W. Zimmerman, 8219 Clinton Rd., Cleveland, Ohio 44144

[21] Appl. No.: 441,297

[22] Filed: Nov. 27, 1989

[51] Int. Cl.[5] ..... B43L 13/10

[52] U.S. Cl. ..... 33/23.01; 33/23.03; 33/23.08

[58] Field of Search ..... 33/23.01, 23.02, 23.03, 33/23.08, 24.1, 24.3, 41.1, 41.3, 41.5, 45, 1 MP; 74/569

[56] References Cited

U.S. PATENT DOCUMENTS

| | | | |
|---|---|---|---|
| 935,728 | 10/1909 | Arp et al. | 33/23.01 |
| 1,154,596 | 9/1915 | Baldridge . | |
| 1,878,322 | 9/1932 | Preston et al. . | |
| 1,903,570 | 4/1933 | Kremmling . | |
| 1,904,623 | 4/1933 | Malcolm et al. | 33/23.01 |
| 2,305,167 | 12/1942 | Kasper | 33/23.03 |
| 2,543,184 | 2/1951 | Marvosh | 33/23.03 |
| 2,736,616 | 2/1956 | Brame | 308/6 |
| 2,986,598 | 5/1961 | Hell | 33/23.01 |
| 3,114,205 | 12/1963 | Bechtle | 33/23 |
| 3,130,497 | 4/1964 | Colten | 33/23.03 |
| 3,290,783 | 12/1966 | Carella | 33/23.01 |
| 3,375,045 | 3/1968 | Zeidler | 308/6 |
| 3,729,830 | 5/1973 | Blachut et al. | 33/23.03 |
| 3,809,516 | 5/1974 | Komaki | 425/150 |
| 3,888,162 | 6/1975 | Maenner | 33/23.01 |
| 3,963,281 | 6/1976 | Reigler et al. | 308/6 |
| 4,219,933 | 9/1980 | Kita et al. | 33/24.1 |
| 4,698,005 | 10/1987 | Kikuchi et al. | 425/163 |
| 4,715,730 | 12/1987 | Magnuson | 384/52 |

FOREIGN PATENT DOCUMENTS

| | | | |
|---|---|---|---|
| 0390436 | 10/1908 | France | 33/23.02 |

*Primary Examiner*—William A. Cuchlinski, Jr.
*Assistant Examiner*—C. W. Fulton
*Attorney, Agent, or Firm*—Fay, Sharpe, Beall, Fagan, Minnich & McKee

[57] ABSTRACT

A method of causing an object to follow a fixed path comprises the steps of forming a rod into the shape of the fixed path, locating the object a fixed and precise distance from the rod by attaching the object to a rigid member which follows the rod and translating the rigid member the extent of the rod. A follower which follows the arcuate rod allows rotational movement around an axis while allowing simultaneous translational movement parallel to the axis. Tilting of the follower is translated to the tracing object.

9 Claims, 6 Drawing Sheets

ADHESIVE APPLICATOR FOR CONTOURED SURFACES

BACKGROUND OF THE INVENTION

1. Field of the Invention

This invention relates generally to a method of causing an object to follow a fixed path in three-dimensional space, and more specifically to a method and an apparatus for laying down a bead of adhesive along a specific path in three-dimensional space.

2. Description of Related Art

Similar objectives have been realized by utilizing programmable robots. While such robots have been used with good success, and are programmable, they can be costly. The present invention is not as easily programmable as a robot but accomplishes similar objectives at a significantly reduced cost.

In one aspect of the invention, assemblies are used to guide machine components in linear movement.

U.S. Pat. No. 3,375,045 to Zeidler discloses bearing assemblies employed to guide elongated machine components for linear or translational movement.

According to a further aspect of the invention, an object, e.g. a tracing object, follows a path in three-dimensional space.

U.S. Pat. No. 3,114,205 to Bectle discloses an apparatus for cutting sheet metal and marking the profiled sheet metal. The apparatus disclosed follows a predetermined path according to a control drawing. Similarly, U.S. Pat. No. 1,154,596 to Baldridge discloses a tracing mechanism.

While the art related above has proven to be somewhat successful in various aspects of causing an object to follow a fixed path of three-dimensional space, the current invention concerns a simple and low cost method that accomplishes these same objectives in an improved manner.

BRIEF SUMMARY OF THE INVENTION

In accordance With the present invention, a method of causing an object to follow a fixed path is provided. The method comprises the steps of forming a rod into the shape of a fixed path, locating the tracing object a fixed and precise distance from the rod by attaching the tracing object to a rigid member which follows the rod, and translating the rigid member the extent of the rod.

In accordance with a further aspect of the invention, the rigid member is translated along the extent of the rod by pneumatic cylinders, hydraulic cylinders, or electric motors.

According to a further aspect of the invention, a method of laying a bead of adhesive along a desired path on an object comprises the steps of forming a rod into the shape of the desired path of the bead of adhesive, locating the desired path a fixed and precise distance from the rod by attaching a dispensing means for dispensing adhesive to a rigid member which follows the rod, translating the rigid member along the extent of the rod via a translating means for translating, and dispensing the adhesive along the desired path via the dispensing means.

According to a further aspect of the invention, the rigid member which is attached to the dispensing means is translated along the extent of the rod by either pneumatic cylinders, hydraulic cylinders, or electric motors positioned to provide movement along three mutually perpendicular axes.

A method of laying down a bead of adhesive along a desired path on an object further comprises sensing the progress of the rigid member along the extent of the rod during the translating and dispensing, and controlling the translating means for translating and dispensing means for dispensing adhesive by referencing the position of the rigid member.

According to a further aspect of the invention, a follower for translational and rotational movement on an arcuate rod comprises an outer housing, rotational means for rotational movement, an inner housing, and translation means for translation movement. The rotational means is mounted within the outer housing, the axis being the centerline of the arcuate rod. The inner housing is mounted within the rotational means. The translation means is mounted within the inner housing, the axis being the centerline of the arcuate rod.

According to a further aspect of the invention, the rotational means for rotational movement is a roller bearing.

According to a further aspect of the invention, the translational means for translational movement is at least one cam follower. In one embodiment of the invention there are three cam rollers spaced equally about the periphery of the arcuate rod.

According to a further aspect of the invention, a follower for translational and rotational movement on an arcuate rod comprises an outer housing, a roller bearing, an inner ring, an inner housing, and a plurality of cam rollers. The outer surface of the roller bearing is adapted to fit against the inner periphery of the outer housing. The outer surface of the inner ring is adapted to fit against the inner periphery of the roller bearing. The outer surface of the inner housing is adapted to fit against the inner periphery of the inner ring. The cam rollers are mounted within the inner housing and rotatably contact the arcuate rod at points spaced equidistantly about the outer surface of the arcuate rod.

According to a further aspect of the invention, an apparatus for translating a tracing object along a predetermined three-dimensional path comprises an arcuate rod, a follower, first constraining means, first mounting means, second constraining means, second mounting means, third constraining means, third mounting means, translating means, a spacing member, and a tracing object. The arcuate rod is formed into the shape of the path to be traced. The follower is mounted on the rod and is selectively translatable along the extent of the rod. The follower is mounted on the first constraining means for constraining translation along a straight line. The first mounting means is for slidably mounting the follower on the first constraining means. The first constraining means is slidably mounted on the second constraining means for constraining translation along a straight line perpendicular to the straight line of the first constraining means. The second mounting means is for slidably mounting the first constraining means on the second constraining means. The second constraining means is slidably mounted on the third constraining means for constraining translation along a straight line perpendicular to the straight lines of the first and second constraining means. The third mounting means is for slidably mounting the second constraining means on the third constraining means. The translating means is to translate the follower along the extent of the arcuate rod. The spacing member has first and second ends, the first end of the spacing member being attached to the follower. The tracing object is attached to the second end of the spacing member.

According to a further aspect of the invention, the first, second, and third constraining means are pairs of parallel rods.

In a different embodiment of the invention, the first, second, and third constraining means are shafts with keyways.

According to a still further embodiment of the invention, the first, second, and third constraining means are blocks adapted for tongue and groove operation.

According to a further aspect of the invention, an apparatus for translating a tracing object along a predetermined three-dimensional path includes a second mounting means for slidably mounting the first constraining mean on the second constraining means. The second mounting mean comprises an axis plate and a plurality of ball-bushing pillow blocks. The axis plate has a first and second side. A plurality of ball-bushing pillow blocks are fixedly mounted on the first side of the axis block with at least two pillow blocks positioned to receive each rod of the first constraining means. Further a plurality of ball-bushing pillow blocks are fixedly mounted on the second side of the axis block with at least two pillow blocks positioned to receive each rod of the second constraining means.

According to a further aspect of the invention, the third mounting means for slidably mounting the second constraining means on the third constraining means comprises an axis box, supporting means, and a plurality of ball-bushing pillow blocks. The axis box has a top, a bottom, and a back. The supporting means is for supporting the second constraining means between the top and bottom of the axis box. The supporting means is fixedly attached to the top and bottom of the box and to the second constraining means. The plurality of ball-bushing pillow blocks are fixedly mounted on the outside of the back of the axis box. At least two pillow blocks are positioned to receive each rod of the third constraining means.

According to a further aspect of the invention, the follower comprises an outer housing, rotational means for rotational movement, an inner housing, and translational means for translational movement. The rotational means for rotational movement around an axis is mounted within the housing, the axis being the centerline of the arcuate rod. The inner housing is mounted within the means for rotational movement. The translational means for translational movement parallel to an axis is mounted within the inner housing, the axis being the centerline of the arcuate rod.

According to a further aspect of the invention, in an apparatus for translating a tracing object along a predetermined three-dimensional path, the follower comprises an outer housing, a roller bearing, an inner ring, an inner housing, and a plurality of cam rollers. The outer surface of the roller bearing is adapted to fit against the inner periphery of the outer housing. The inner ring is adapted to fit against the inner periphery of the roller bearing. The inner housing is adapted to fit against the inner periphery of the inner ring. The cam rollers are mounted within the inner housing and are rotatably in contact with the arcuate rod at points spaced equidistantly about the outer surface of the arcuate rod.

According to a further aspect of the invention, in an apparatus for translating and rotating a tracing object along a predetermined three-dimensional path, the apparatus comprises an arcuate rod, a follower, a yoke, a junction block, attaching means, first constraining means, first mounting means, second constraining means, second mounting means, third constraining means, third mounting means, translating means, a spacing member, a tracing object, and transmitting means. The arcuate rod is formed into the shaped of the path to be traced. The follower is mounted on the rod and is selectively translatable along the extent of the rod. The follower has a primary plane which remains substantially perpendicular to the axis of the arcuate rod at each point along the extent of the rod. The yoke has a first end and a second end, with the first end of the yoke fixedly attached to the follower. The second end of the yoke is rotatably attached to the junction block. The attaching means fixedly attaches the junction block to the follower and spaces it therefrom. The first constraining means constrains translation along a straight line. The junction block is slidably mounted on the first constraining means. The first mounting means slidably mounts the junction block on the first constraining means. The second constraining means is for constraining translation along a straight line perpendicular to the straight line of the first constraining means. The first constraining means is slidably mounted on the second constraining means. The second mounting means is for slidably mounting the first constraining means on the second constraining means. The third constraining means is for constraining translation along a straight line perpendicular to the straight lines of the first and second constraining means. The second constraining means is slidably mounted on the third constraining means. The third mounting means is for slidably mounting the second constraining means on the third constraining means. The translating means translates the follower along the extent of the arcuate rod. The spacing member has a first end, which is attached to the junction block, and a second end. The tracing object is attached to the second end of the spacing member. The transmitting means transmits rotational motion from the yoke to the tracing object.

According to another aspect of the invention, the yoke transmits rotational movement in substantially only one plane.

According to another aspect of the invention, the transmitting means for transmitting rotational motion from the yoke to the tracing object comprises a first gear fixedly mounted on the yoke, a second gear fixedly mounted on the tracing member, and a chain drive connecting the first gear and a second gear.

According to a further aspect of the invention, the transmitting means for transmitting rotational motion from the yoke to the tracing object comprises a first ball rod end, a second ball rod end, and a link rod connecting the first ball rod end and the second ball rod end.

BRIEF DESCRIPTION OF THE DRAWINGS

The invention may take physical form in certain parts and arrangement of parts. A preferred embodiment of the invention will be described in detail in the specification and is illustrated in the accompanying drawings wherein.

DESCRIPTION OF THE PREFERRED EMBODIMENT

Figure 1:
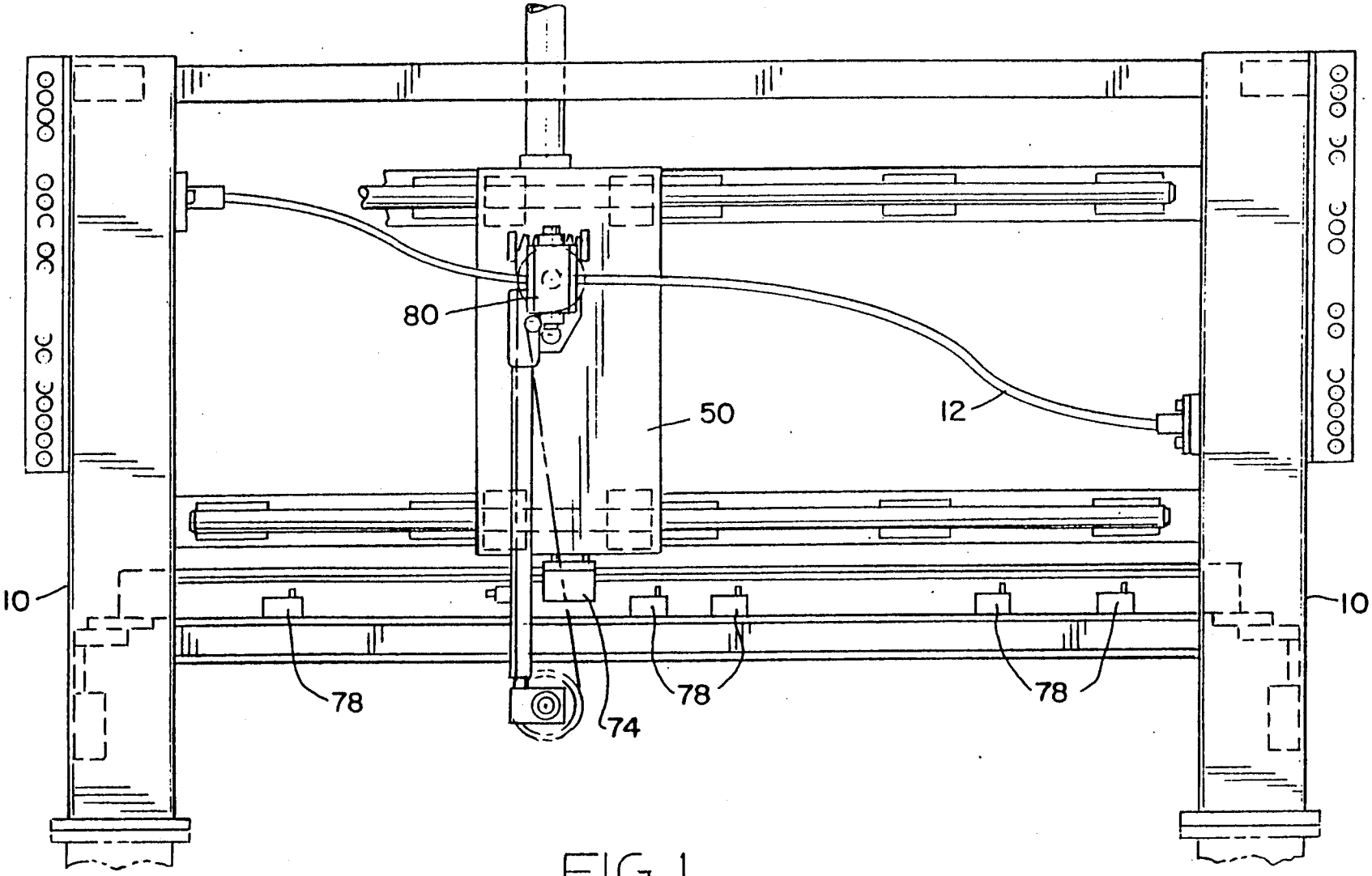
FIG. 1 is a front view of an adhesive applicator for contoured surfaces according to the invention.

Referring now to the drawings, wherein the showings are for purposes of illustrating a preferred embodiment of the invention only and not for purposes of limiting same, FIG. 1 is a front view of an adhesive applicator for contoured surfaces according to the present invention. Although the invention was first developed for the specific application of adhesive application to a contoured surface in three-dimensional space, the scope of the invention is not limited to this application. More accurately, the invention concerns the translation of an object, such as an adhesive nozzle, through three-dimensional space along an arcuate path, and accomplishing this translation in a reliable, durable, and cost effective manner. As such, the invention has many other uses besides the application of adhesive to a contoured surface.

For example, the invention is easily applied to a welding operation. Instead of mounting a tracing means or a glue nozzle as an end effector, a spot welding gun could be used. The arcuate rod could be formed into the shape of the path necessary to reach each point to be welded. As the welding gun followed the path, control means could instruct the welder when to place a spot weld on the work piece.

Similarly, the invention could be applied to the sewing industry in applications where a sewing needle is required to follow a three-dimensional path.

Another application for the invention is in the assembly function. Similar to the spot welder discussed above, a pop riveter could be mounted as an end effector. In such an application, the end effector would follow a path dictated by the arcuate rod and could rivet, and thereby assemble, a workpiece.

Additionally, the invention could be used in the machining industry. Various types of machine tool equipment, such as a milling tool, could be mounted as an end effector and could be instructed to follow a prescribed path in three-dimensional space.

Figure 2:
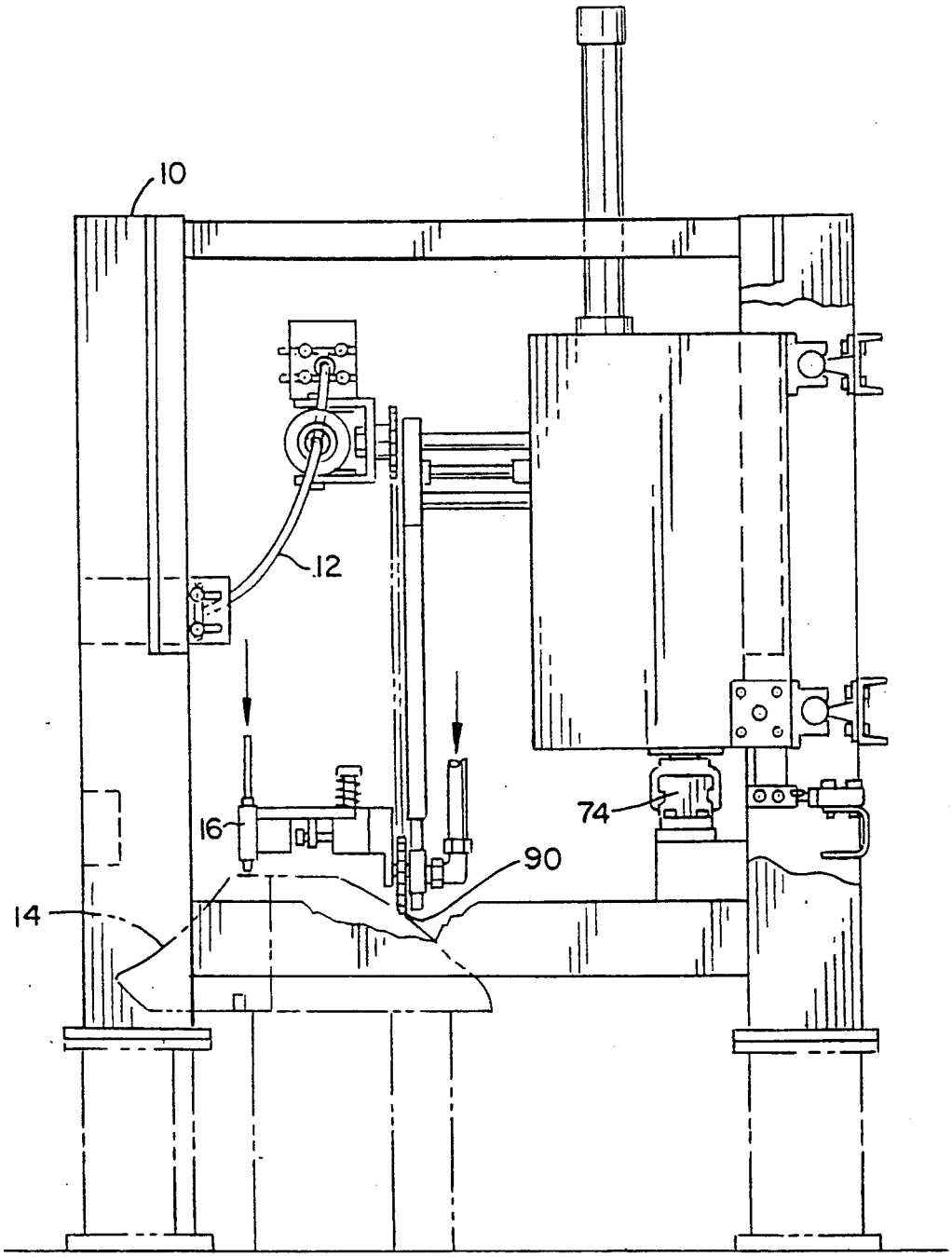
FIG. 2 is a right-hand end view of an applicator according to the present invention.
Figure 3:
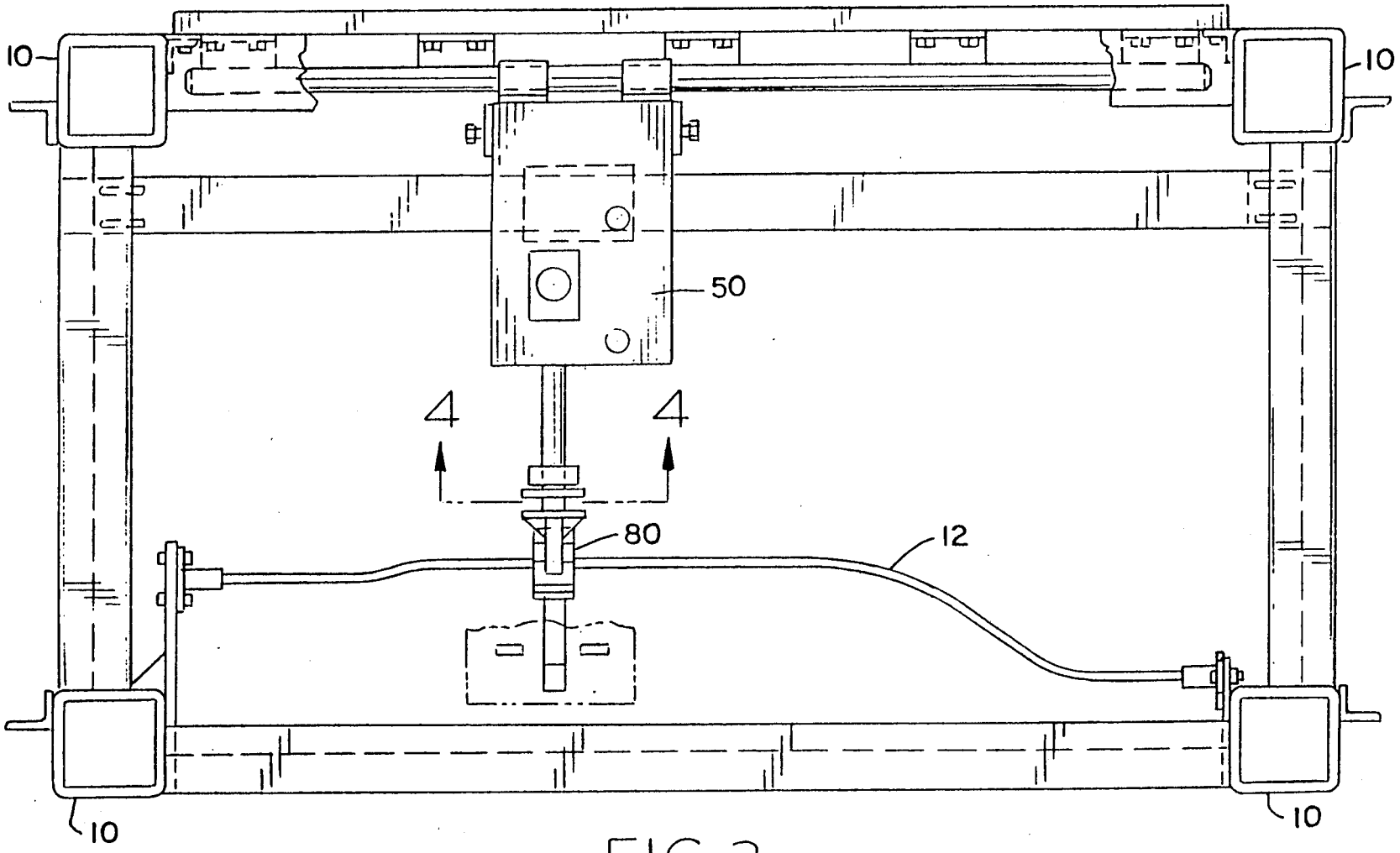
FIG. 3 is a plan view of an applicator according to the present invention.

As shown in FIG. 1–3, the apparatus is mounted on a rectangular frame 10. The invention may also be practiced in other ways other than a floor-mounted frame; for example, the invention could be suspended from a ceiling. Suspended within the frame is an arcuate rod 12. The arcuate rod 12 may be suspended within the frame in any manner which is secure enough to allow the follower to be translated the extent of the rod. In the preferred embodiment, each end of the rod is welded to a plate which is then rigidly affixed to the frame. The arcuate rod is formed into whatever shape the user wishes for the tracing object to follow. By the word "rod" or "arcuate rod", applicants intend to include objects with non-circular cross-sections. For example, the arcuate rod could have a square cross-section. For example, in an application involving the applying of a bead of adhesive to an automobile fender, the rod 12 is formed into the shape which the bead of adhesive should follow on the surface of the fender. With reference to FIG. 2, the rod 12 is suspended above an automobile fender 14. The tracing means 16, in this particular application the glue nozzle, follows the contour of the arcuate rod which is suspended thereabove.

As was detailed earlier in this application, other art has been developed which causes a tracing object to follow a predetermined path in space. Notably, in the recent past, this function has been performed by programmable robots. However, these robots are complicated, expensive, and are often much more flexible than is required for many applications. The subject invention is less flexible than a programmable robot, in that a new arcuate rod must be formed each time a different path is desired, but it is durable, simple, and inexpensive.

The current invention utilizes three mutually perpendicular axes to translate the tracing object through three-dimensional space. While a variety of means to constrain translational movement along a straight line may be used, in the preferred embodiment, pairs of parallel rods are utilized.

Figure 5:
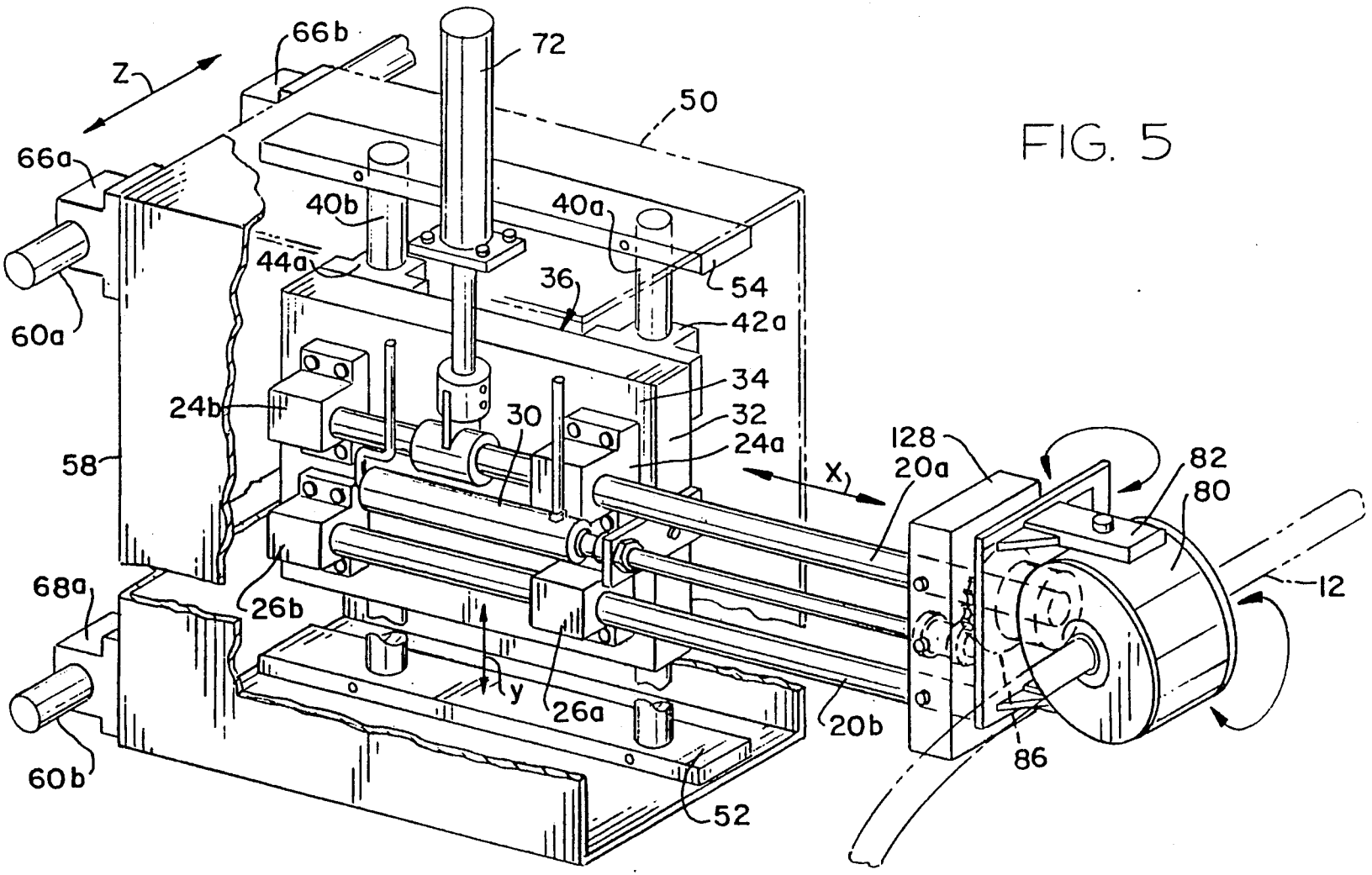
FIG. 5 is a cross-sectional, perspective view of the axis box, the yoke, the follower, and other aspects of the current invention; and, FIG. 6 is a schematic, exploded view of the follower and yoke.

As seen best in FIG. 5, a first constraining means for constraining translation along a straight line is preferably a pair of parallel rods 20, **20*b*. These parallel rods are slidably received in ball-bushing pillow blocks 24*a*, 24*b*, 26*a*, 26*b*. A translating means provides translational movement along the axis of the parallel rods 20*a*, 20*b*. In the preferred embodiment the translating means is a pneumatic cylinder 30. The ball-bushing pillow blocks 24*a*, 24*b*, 26*a*, 26*b*, are fixedly mounted on an axis plate 32. The axis plate has a first side 34 and a second side 36. For purposes of discussion, the direction parallel to the parallel rods 20*a*, 20*b*** will be denoted the x direction.

With continuing reference to FIG. 5, in a similar way, translation is obtained in the y direction via second constraining means **40*a*, 40*b*. In the preferred embodiment, the second constraining means is a pair of parallel rods 40*a*, 40*b*. For discussion purposes, the direction parallel to that of parallel rods 40*a*, 40*b* will be denoted as the y direction. The y direction is perpendicular to the x direction. Parallel bars 40*a*, 40*b* are slidably mounted within ball-bushing pillow blocks 42*a*, 42*b*, 44*a*, 44*b* (ball-bushing pillow block 42*b*, 44*b* are not shown). The ball-bushing pillow blocks 42*a*, 42, 44*a*, 44*b*, are fixedly mounted to the second side 36 of the axis plate 32. The first and second constraining means are mounted within an axis box 50. This mounting is accomplished via supporting means 52, 54. The supporting means 52 is fixedly mounted to the bottom of the axis box 50 and to the second constraining means 40*a*, 40*b*. Likewise, the supporting means 54 is fixedly mounted to the top of the axis box 50 and to the second constraining means 40*a*, 40*b***.

With continuing reference to FIG. 5, mounted on the back 58 of the axis box 50 are ball-bushing pillow blocks **66*a*, 66*b*, 68*a*, 68*b* (pillow block 68*b* is not shown in FIG. 5). A third constraining means 60*a*, 60*b* is adapted to be slidingly received through the pillow blocks 66*a*, 66*b*, 68*a*, 68*b*. In the preferred embodiment, the third constraining means comprises a pair of parallel rods 60*a*, 60*b*. For purposes of illustration, the direction parallel to that of parallel rods 60*a*, 60*b*** shall be denoted as the z direction. The z direction is perpendicular to the x direction and to the y direction; in fact, each of the x, y, and z directions are mutually perpendicular to each other.

A pneumatic cylinder 72 provides translation along the second constraining means in the y direction. Additionally, as seen in FIGS. 1 and 2, a third translating means 74 translates the axis box along the z direction. In the preferred embodiment, the third translating means is a rodless cylinder 74. A rodless cylinder is preferred because it allows the axis box to travel nearly the width of the frame 10 without the rodless cylinder 74 extending beyond the confines of the frame 10. A rodless cylinder is able to provide translational movement in approximately half the distance required by a pneumatic or hydraulic cylinder with equivalent travel.

The translational motion provided by the first, second, and third translating means 30, 72, 74 is regulated by means of a pneumatic control system. With reference to FIG. 1, the pneumatic control system (not shown) receives inputs from sensors 78 located along the travel of the third translating means 74. These sensors may take the form of limit switches or other means effective to convey the location of the axis box 50 to the pneumatic controller. The pneumatic controller is programed to receive information regarding the location of the axis box along the travel of the z direction. Upon receiving this input, the controller provides the proper amount of thrust to any of the three translating means to push a follower 80 along the arcuate rod.

Figure 6:
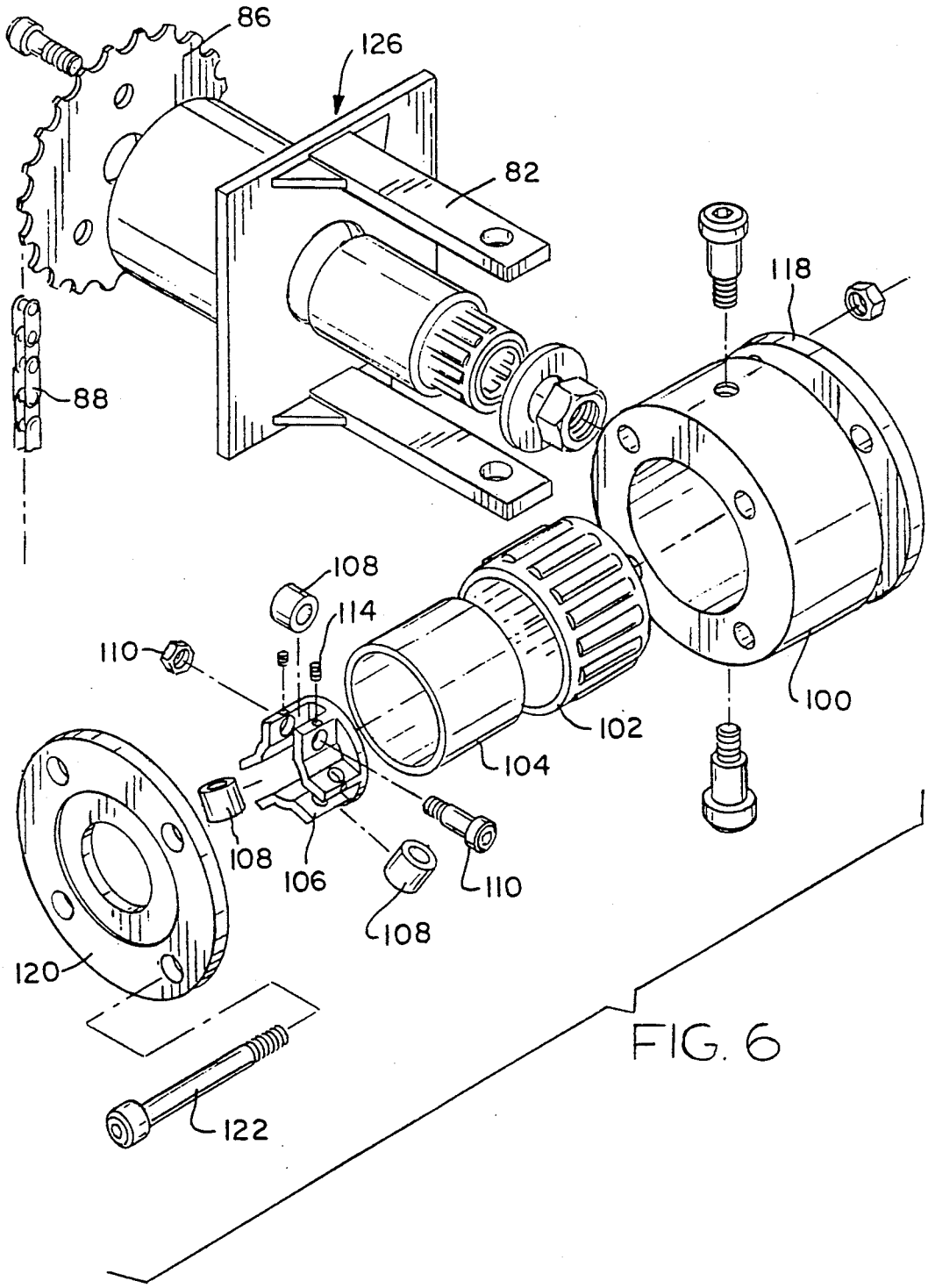

With reference to FIG. 5 and FIG. 6, the follower 80 is adapted to receive the arcuate rod 12. The follower 80 is pivotally received within and attached to the arms of yoke 82. The yoke 82 is fixably attached to sprocket 86. As the follower 80 follows the arcuate rod 12, the follower 80 tilts. The follower 80 tilts to keep the primary plan of the roller guide approximately perpendicular to the axis of the arcuate rod 12. The tilting is translated to the arms of the yoke, thereby rotating sprocket 86.

With reference to FIG. 5 and FIG. 6, the first end 126 of yoke 82 is rotatably attached to a junction block 128. The junction block 128 is mounted on the first constraining means **20*a*, 20*b***.

Figure 4:
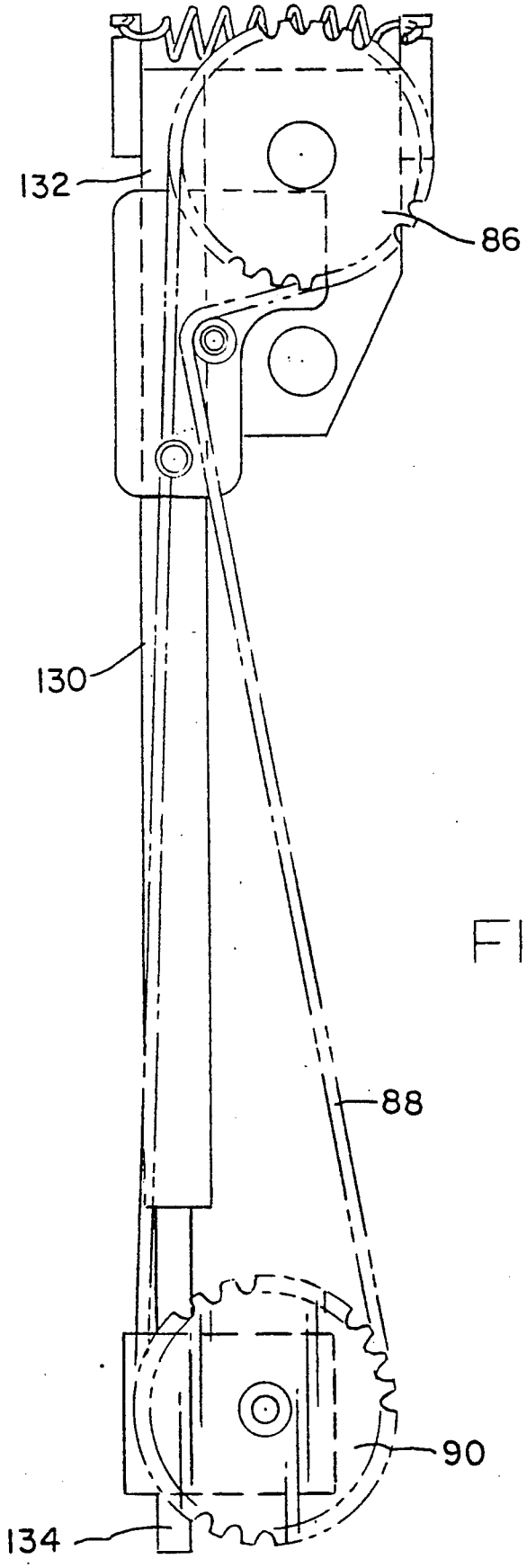
FIG. 4 is a cross-sectional view of the transmitting means for transmitting rotational motion from the yoke to the tracing object.

Attached to the junction block 128 is spacing member 130. With reference to FIG. 4, the first end 132 of the spacing member 130 is fixedly attached to the junction block 128. Sprocket 90 is rotatably attached to the second end 134 of the spacing member 130.

With reference to FIG. 4 and FIG. 6, sprocket 86 is connected to sprocket 90 via a chain 88. Any rotation of sprocket 86 causes a corresponding rotation of sprocket 90 through the chain. As seen best in FIG. 2, the tracing object 16 is fixably attached to sprocket 90. Therefore any rotation of the lower guide assembly 80 causes a corresponding rotation in the tracing object. In the current embodiment, the tracing object is a glue nozzle 16. The practical benefit of this mechanism is that the glue nozzle is always oriented at a right angle to the glued surface. It is believe that the glue will be applied more uniformly if the glue nozzle is oriented approximately perpendicularly to the surface 14 to be glued.

With reference now to FIG. 6, there is shown a schematic, exploded, perspective view of the follower 80. The follower comprises an outer housing 100. On either side of the housing are end plates 118, 120 which are held to the housing by fasteners 122. Mounted within the outer housing 100 is a rotational means 102 for rotational movement around an axis. In the preferred embodiment, the rotational means for rotational movement is a roller bearing 102. The outer surface of the roller bearing is adapted to fit against the inner periphery of the outer housing 100. An inner ring 104 is adapted to fit within the inner periphery of the roller bearing. An inner housing 106 is adapted to fit within the inner periphery of the inner ring. Mounted within the inner housing is a translational means 108 for translational movement parallel to an axis, in this case, the axis being the centerline of the arcuate rod. In the preferred embodiment, the translational means is a plurality of cam rollers 108. These cam rollers are rotatably mounted within the inner housing via fasteners 110. Adjusting screws 114 allow adjustment of the amount of play between the cam rollers 108 and the arcuate rod 12. The arcuate rod 12 is slidingly received within the follower. The cam rollers 108 rotatably contact the arcuate rod 12 at points spaced equidistantly about the outer surface of the arcuate rod. The cam rollers 108 allows translational movement along the extent of the arcuate rod while the roller bearing 102 allows rotational movement of the follower around the arcuate rod.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. An apparatus for translating a tracing object along a predetermined three-dimensional path, the apparatus comprising:

an arcuate rod formed into the shape of the path to be traced;

a follower mounted on the rod and selectively translatable along the extent of the rod;

first constraining means for constraining translation along a straight line, the follower mounted on the first constraining means;

first mounting means for mounting the follower on the first constraining means;

second constraining means for constraining translation along a straight line perpendicular to the straight line of the first constraining means, the first constraining means slidably mounted on the second constraining means;

second mounting means for slidably mounting the first constraining means on the second constraining means;

third constraining means for constraining translation along a straight line perpendicular to the straight lines of the first and second constraining means, the second constraining means being slidably mounted on the third constraining means;

third mounting means for slidably mounting the second constraining means on the third constraining means;

translating means to translate the follower along the extent of the arcuate rod;

a spacing member having first and second ends, the first end of the spacing member being attached to the follower; and, a tracing object, the tracing object attached to the second end of the spacing member.

2. An apparatus for translating a tracing object along a predetermined three-dimensional path as in claim 1 wherein the first, second, and third constraining means are pairs of parallel rods.

3. An apparatus for translating a tracing object along a predetermined three-dimensional path as in claim 2 wherein the second mounting means for slidably mounting the first constraining means on the second constraining means comprises:

an axis plate, the axis plate having a first and second side;

a plurality of ball-bushing pillow blocks fixedly mounted on the first side of the axis block, at least two pillow blocks positioned to receive each rod of the first constraining means; and, a plurality of ball-bushing pillow blocks fixedly mounted on the second side of the axis block, at least two pillow blocks positioned to receive each rod of the second constraining means.

4. An apparatus for translating a tracing object along a predetermined three-dimensional path as in claim 3 wherein the third mounting means for slidably mounting the second constraining means on the third constraining means comprises:

an axis box, the axis box having a top, a bottom, and a back;

supporting means for supporting the second constraining means between the top and bottom of the axis box, the supporting means fixedly attached to the top and bottom of the box and to the second constraining means; and, a plurality of ball-bushing pillow blocks fixedly mounted on the outside of the back of the axis box, at least two pillow blocks positioned to receive each rod of the third constraining means.

5. An apparatus for translating a tracing object along a predetermined three-dimensional path as in claim 1 wherein the follower comprises:

an outer housing;

rotational means for rotational movement around an axis, the means for rotational movement mounted within the housing, the axis being the centerline of the arcuate rod;

an inner housing, the inner housing mounted within the means for rotational movement; and translational means for translational movement parallel to the axis, the translational means for translational movement mounted within the inner housing.

6. An apparatus for translating a tracing object along a predetermined three-dimensional path as in claim 1 wherein the follower comprises:

an outer housing;

a roller bearing, the outer surface of the roller bearing adapted to fit against the inner periphery of the outer housing;

an inner ring adapted to fit against the inner periphery of the roller bearing;

an inner housing adapted to fit against the inner periphery of the inner ring; and a plurality of cam rollers mounted within the inner housing, the cam rollers rotatably in contact with the arcuate rod at points spaced equidistantly about the outer surface of the arcuate rod.

7. An apparatus for translating and rotating a tracing object along a predetermined three-dimensional path, the apparatus comprising:

an arcuate rod formed into the shape of the path to be traced;

a follower mounted on the rod and selectively translatable along the extent of the rod, the follower having a primary plane, the primary plane of the follower remaining substantially perpendicular to the axis of the arcuate rod at each point along the extent of the rod;

a yoke, the yoke having a first end and a second end, the first end of the yoke fixedly attached to the follower;

a junction block, the second end of the yoke rotatably attached to the junction block;

attaching means to fixedly attach the junction block to and space it from the follower;

first constraining means for constraining translation along a straight line;

the junction block mounted on the first constraining means;

first mounting means for mounting the junction block on the first constraining means;

second constraining means for constraining translation along a straight line perpendicular to the straight line of the first constraining means, the first constraining means slidably mounted on the second constraining means;

second mounting means for slidably mounting the first constraining means on the second constraining means;

third constraining means for constraining translation along a straight line perpendicular to the straight lines of the first and second constraining means, the second constraining means being slidably mounted on the third constraining means;

third mounting means for slidably mounting the second constraining means on the third constraining means;

translating means to translate the follower along the extent of the arcuate rod;

a spacing member having first and second ends, the first end of the spacing member being attached to the junction block;

a tracing object, the tracing object attached to the second end of the spacing member; and, transmitting means for transmitting rotational motion from the yoke to the tracing object.

8. An apparatus for translating and rotating a tracing object along a predetermined three-dimensional path as in claim 7 wherein the yoke transmits rotational movement in substantially only one plane.

9. An apparatus for translating and rotating a tracing object along a predetermined three-dimensional path as in claim 7 wherein the transmitting means for transmitting rotational motion from the yoke to the tracing object comprises:

a first gear fixedly mounted on the yoke;

a second gear fixedly mounted on the tracing member; and a chain drive connecting the first gear and the second gear.

* * * * *